US009833060B2

(12) United States Patent
Saltalamacchia

(10) Patent No.: US 9,833,060 B2
(45) Date of Patent: Dec. 5, 2017

(54) MULTIFUNCTIONAL, ELECTRONIC, LIGHT EMITTABLE AND REMOVABLE SLEEVE FOR PAINTBRUSH

(71) Applicant: Emanuele Antonio Saltalamacchia, Garfield, NJ (US)

(72) Inventor: Emanuele Antonio Saltalamacchia, Garfield, NJ (US)

( * ) Notice: Subject to any disclaimer, the term of this patent is extended or adjusted under 35 U.S.C. 154(b) by 0 days.

(21) Appl. No.: 15/052,850

(22) Filed: Feb. 24, 2016

(65) Prior Publication Data

US 2016/0166054 A1 Jun. 16, 2016

Related U.S. Application Data

(63) Continuation-in-part of application No. 13/473,425, filed on May 16, 2012, now Pat. No. 9,638,411,
(Continued)

(51) Int. Cl.
*H04R 1/02* (2006.01)
*A46B 15/00* (2006.01)
(Continued)

(52) U.S. Cl.
CPC ..... *A46B 15/0036* (2013.01); *A46B 5/02* (2013.01); *B25G 1/02* (2013.01); *B25G 1/102* (2013.01);
(Continued)

(58) Field of Classification Search
CPC ..... A46B 5/02; A46B 15/0002; A46B 15/004; A46B 15/0028; A46B 15/0036;
(Continued)

(56) References Cited

U.S. PATENT DOCUMENTS

D572,907 S * 7/2008 Byrne ..... D4/199
9,032,580 B2 * 5/2015 Freuler ..... B25G 1/00 15/143.1

(Continued)

OTHER PUBLICATIONS

James Byrne, The Wooster Brush Company, <http://www.coroflot.com/jmbyrne/The-Wooster-Brush-Company>, Oct. 14, 2009.*

*Primary Examiner* — Duc Nguyen
*Assistant Examiner* — Kile Blair

(57) ABSTRACT

A multifunctional and removable electronic light emitting grip sleeve for a paintbrush configured to receive a paintbrush and to improve handling and controlling over the paintbrush. The electronic light emitting grip sleeve includes a brush encasement, a pistol grip, and a finger guard are ergonomically connected and contoured to improve the gripping capabilities of the electronic light emitting grip sleeve. A first and second elastic walls within the brush encasement secure a paintbrush that become lodged as it is inserted. A plurality of illuminating members of the brush encasement that is powered by an internal power source or an interchangeable illuminating brush head that is powered by a remote power source allows the painter to direct light on a painted surface as needed. Additionally, a multitude of electronic components are installed into the brush encasement to increase productivity and provide convenience for the painter.

11 Claims, 18 Drawing Sheets

Related U.S. Application Data which is a continuation-in-part of application No. 29/552,758, filed on Jan. 26, 2016.

(60) Provisional application No. 61/486,432, filed on May 16, 2011.

(51) Int. Cl.

| | |
|---|---|
| ***F21V 33/00*** | (2006.01) |
| ***B25G 1/10*** | (2006.01) |
| ***A46B 5/02*** | (2006.01) |
| ***B25G 1/02*** | (2006.01) |
| *F21Y 115/10* | (2016.01) |

(52) U.S. Cl.

CPC ..... *F21V 33/0056* (2013.01); *F21V 33/0084* (2013.01); *H04R 1/028* (2013.01); *A46B 2200/202* (2013.01); *F21Y 2115/10* (2016.08); *H04R 2420/07* (2013.01)

(58) Field of Classification Search

CPC ..... A46B 15/0038; A46B 15/0042; A46B 15/0044; A46B 17/02; A46B 2200/202; B25G 3/10; B25G 1/02; B25G 3/32; B25G 1/102; F21V 33/0056; F21V 33/0084

See application file for complete search history.

(56) References Cited

U.S. PATENT DOCUMENTS

| | | | | |
|---|---|---|---|---|
| 2008/0276396 | A1* | 11/2008 | Lucero | A46B 5/0083 15/144.2 |
| 2012/0227197 | A1* | 9/2012 | Fleischer | A46B 7/04 15/105 |
| 2016/0176039 | A1* | 6/2016 | Creelman | A45F 5/021 224/666 |

* cited by examiner

MULTIFUNCTIONAL, ELECTRONIC, LIGHT EMITTABLE AND REMOVABLE SLEEVE FOR PAINTBRUSH

The current application is a continuation-in-part (CIP) application of a U.S. non-provisional application Ser. No. 13/473,425 filed on May 16, 2012 and U.S. design patent application Ser. No. 29/552,758 filed on Jan. 26, 2016. The U.S. non-provisional application Ser. No. 13/473,425 claims a priority to the U.S. Provisional Patent application Ser. No. 61/486,432 filed on May 16, 2011.

FIELD OF THE INVENTION

The present invention relates generally to a painting accessory. More particularly, the present invention is a paintbrush with an ergonomic grip sleeve surrounding the paintbrush handle and is capable of emitting light upon the painted surface.

BACKGROUND OF THE INVENTION

Paintbrushes are typically manufactured to a set standard. These paintbrushes have a plurality of bristles, a wide paintbrush head and an elongated thin handle in which the bristles are fitted onto the paintbrush head and the paintbrush head is connected to the elongated thin handle. The majority of the weight is distributed near the wide paintbrush head. Oftentimes, this requires a painter to apply a tight grip onto the thin paintbrush handle to hold and operate it, which can become very strenuous over time. This tight grip must constantly be applied onto the handle in order to achieve the best handling over the paintbrush. For recreational painters that may have physical disabilities, particularly with the hand, painting can be near impossible with standard paintbrushes because they are neither ergonomic, nor do they easily grip into the hand of the painter. Gripping and handling these paintbrushes depends upon the painter's physical abilities how much force can be applied from the hand onto the handle and how much strain the hand can tolerate.

Another aspect of painting that is often overlooked is proper lighting on a painting surface. The intensity of light on the surface, the angle the light is directed onto the surface and even the amount of heat that irradiates from the lighting source are all factors leading to a painted surface that is either streak-free and or degraded with blemishes and blotches. A degraded painted surface requires multiple coats of paint to be applied until paint streaks and blotches become no longer noticeable. This is typically a result of the painted surface being poorly lit during the process of painting. In a poorly lit environment, a painted surface may appear streak-free and without blotches; however, such blotches and paint streaks may become increasingly noticeable as the intensity of light upon the surface is increased. If the light is inaccurately directed onto the surface while painting, such blotches and streaks will remain unseen to the painter. Usually floor lights or construction lights and lamps are used to light the painted surface. These can disperse significant amounts of heat into the environment, upon the painted surface and upon the painter. Further from this being an inconvenience, the immense heating can sometimes be detrimental because the wet paint dries before it has been properly distributed across the painted surface. A painter must first recognize that the heat is drying the paint too quickly and then distribute the paint faster. Consequently, if not, the paint may need to be stripped or reapplied.

Poor lighting that leads to poor paint jobs are especially apparent when painting with a paintbrush because the body of the painter can cast a shadow on a surface being painted that is much larger than the paintbrush; ultimately, this defeats the purpose of the lighting. Since most rooms are rectangular, the lighting must be repositioned as each wall is painted because of the shadows being cast from the painter and the adjacent walls. Newer homes or buildings that are to be painted sometimes do not have a power source for the construction lamps and lights to operate. This dilemma forces a painter to use natural lighting within the room or to draw power from a portable generator. Natural light cannot be directed to any location at any instant and portable generators are usually heavy and a nuisance to transport.

Paintbrushes are most commonly used when detailing along lines or contours, as well as edges between two painted surfaces because a painter can more finely control the motion of the paintbrush and the area that is being painted. It can be difficult to paint along the medium between different painted surfaces or dissimilar colors and their respective contours. Therefore, handling and control over the paintbrush is strictly important.

With advancements in technology, electronics are being installed in devices that were once considered too small to withhold them, causing the devices to become bulky. The power requirements may have required large batteries or the electronics processors that actually control the electronics may have been too large to fit into such devices. Nowadays, these electronics processors are capable of operating a multitude of electronics while also being minimal in size. A painter, along with many other labor oriented professions, use a variety of electronics while working such as the lighting system that must be positioned correctly, a stereo to listen to that increases productivity or cellular phones to communicate with others, as examples. Although these electronics have many positive functions and provide much convenience to a painter, operating these electronics while working is difficult because each device must be operated individually. Constant moving from room to room and painting surface to painting surface increases the likelihood of these electronics to need to be relocated and possible reconnected to their respective power sources. Even if the electronics are portable, all would need to be carried by the painter since a painter is moving around often. An all-inclusive single device that comprises these electronics would be convenient and also increase the speed and productivity of the painter.

There are three types of paintbrushes in the construction industry. The first is the old fashioned paintbrush with a wooden or plastic rubbery handle, which is identified as the physical material brush. The second type is a powerful electronic sleeve for brushes that when put together with additional attachments or electrical components that is introduced through the present invention. This is identified as an electronic paintbrush. The third type is a virtual paintbrush that the mind is equipped with, also called imagination. Imagination is like a paintbrush. Very powerful and can be interpreted as a light being shined onto the beholder to see clearly, justly what is being envisioned. The present invention perfectly claims all benefits of these powerful paintbrushes and can simply redesign it freely with alternatives without departing from the very nature of intensions and the functionality. Whether the present invention slides, clamps or materializes or dematerializes, the present invention can be implemented for all type of different painting methods.

It is an object of the present invention is to provide lighting to a surface being painted more effectively; to provide a painter with better handling and control over the paintbrush; and to supply a painter with a single multifunctional electronic device that facilitates painting. The described problems and inconveniences with painting and all claimed objectives of the present invention are solved and achieved with a multifunctional and removable electronic light emitting grip sleeve for a paintbrush.

DETAIL DESCRIPTIONS OF THE INVENTION

All illustrations of the drawings are for the purpose of describing selected versions of the present invention and are not intended to limit the scope of the present invention.

Figure 1:
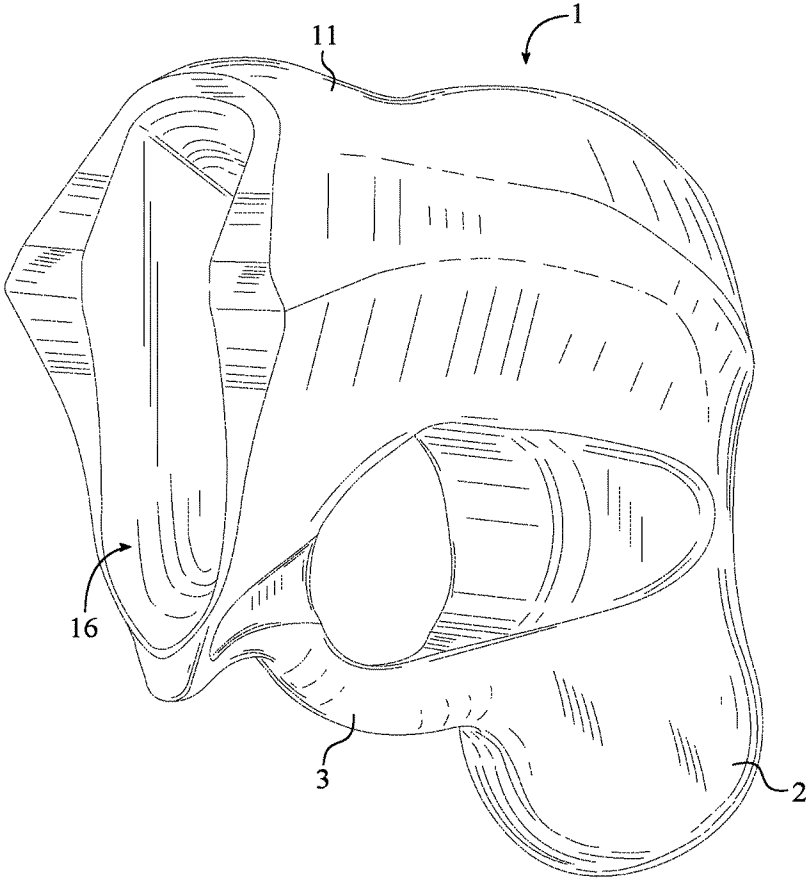
FIG. 1 is a front perspective view of the present invention.
Figure 2:
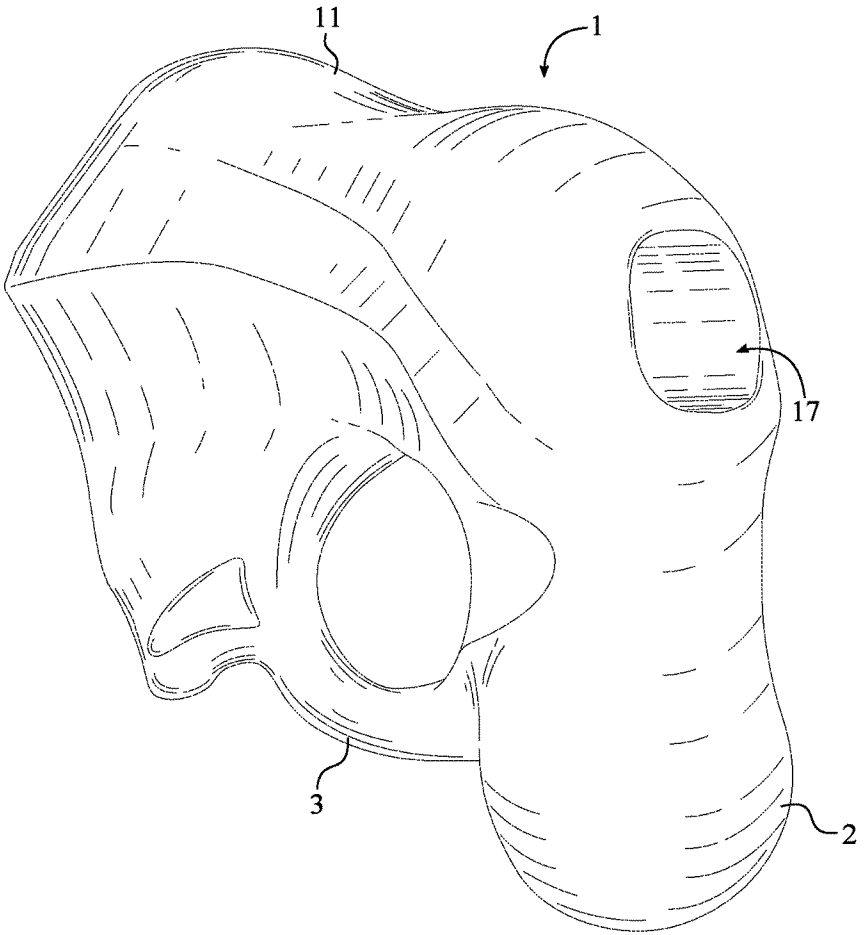
FIG. 2 is a rear perspective view of the present invention.
Figure 3:
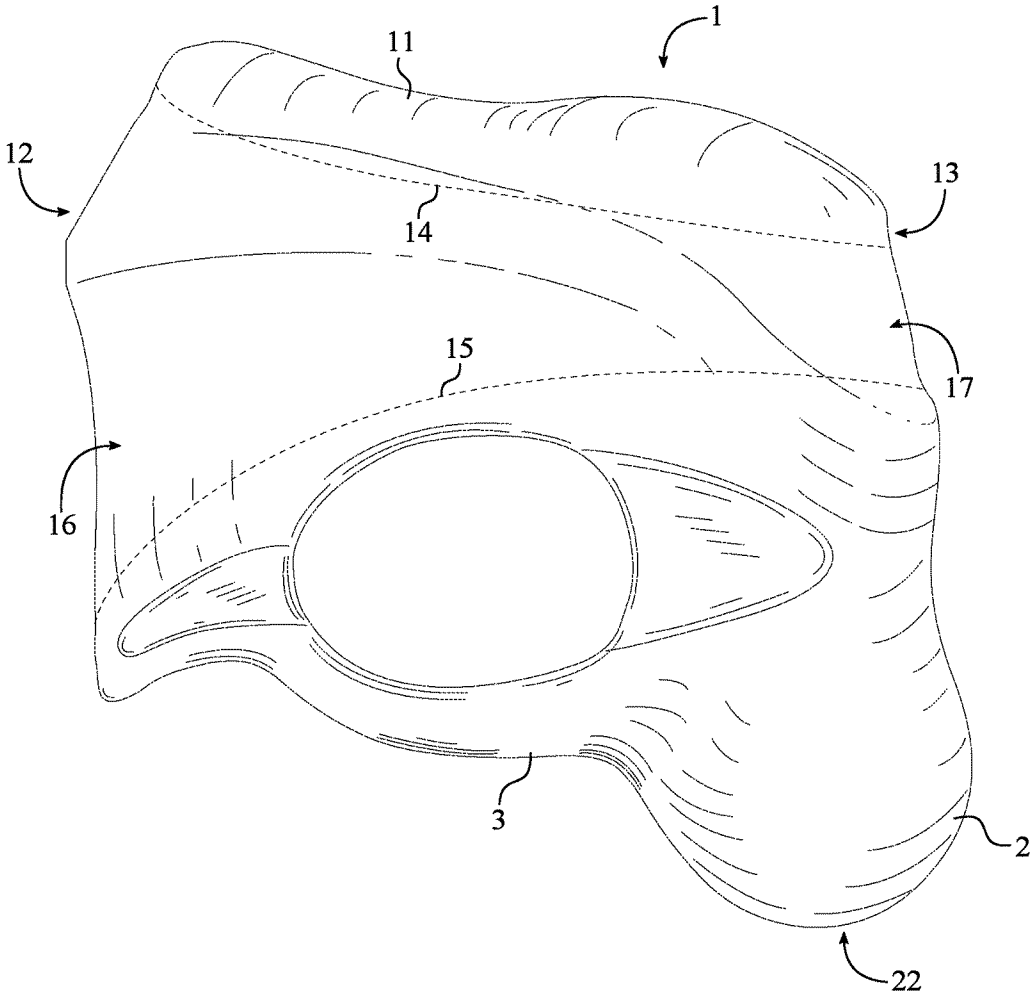
FIG. 3 is a side view of the present invention.

The present invention is a multifunctional and removable electronic light emitting grip sleeve for a paintbrush, which is shown in FIG. 1-FIG. 3. The present invention provides a user, typically a painter, with a specialized holster that grips a paintbrush handle in order to providing multitude of additional features within a single device. The present invention comprises a brush encasement 1, a pistol grip 2, and a finger guard 3. The unique exterior shape of brush encasement 1, the pistol grip 2, and the finger guard 3 allow the ergonomic shape of the present invention to decreases the amount of strain experienced by the painter's hand while holding the present invention with a paintbrush attached. This is enabled by the contrasting wall surfaces and the gradual increasing width of exterior wall surfaces.

The brush encasement 1 encloses the paintbrush handle to secure the paintbrush within the present invention and functions as a platform for the multitude of additional features. In reference to FIG. 1-FIG. 3, the brush encasement 1 comprises an elongated body 11, a wide receiving cavity 16, and a narrow receiving channel 17. The elongated body 11 is generally positioned parallel with the paintbrush and functions as the holster for the paintbrush. More specifically, the wide receiving cavity 16 traverses into the elongated body 11 from a front end 12 of the elongated body 11 and the narrow receiving channel 17 traverses through the elongated body 11 from the wide receiving cavity 16 to a rear end 13 of the elongated body 11. As a result, the elongated body 11, the wide receiving cavity 16, and the narrow receiving channel 17 delineate an opened path for the paintbrush within the brush encasement 1. In reference to FIG. 3, the elongated body 11 comprises a first elastic wall 14 and a second elastic wall 15. The first elastic wall 14 and the second elastic wall 15 are oppositely positioned of each other and internally extended along the wide receiving cavity 16 and the narrow receiving channel 17. More specifically, the first elastic wall 14 and the second elastic wall 15 respectively function as the top surface and bottom surface for the wide receiving cavity 16 and the narrow receiving channel 17 in order to delineate the shape of the opened path. As shown in FIG. 3, the first elastic wall 14 and the second elastic wall 15 are formed into a wave-shaped wall surfaces and tapered from the front end 12 to the rear end 13. Therefore, the opened path has a greater volume adjacent to the front end 12 than rear end 13.

As the paintbrush handle is positioned into the wide receiving cavity 16, the paintbrush handle makes contact with both the first elastic wall 14 and the second elastic wall 15. A compressive pressure force is then induced onto the paintbrush handle from the first elastic wall 14 and the second elastic wall 15; the further distance that the paintbrush handle traverses through the narrow receiving channel 17, the greater the compressive pressure force becomes from the first elastic wall 14 and the second elastic wall 15. This compressive pressure force onto the paintbrush handle causes the paintbrush handle to become temporarily lodged within the brush encasement 1. Since the first elastic wall 14 and the second elastic wall 15 are flexible, they deform and ultimately contour and embody the portion of the paintbrush handle that has made contact with the first elastic wall 14 and the second elastic wall 15. This ensures the painter that the paintbrush is adequately secured within the brush encasement 1, thus ensuring that the handling of the paintbrush is not affected in an adverse fashion. To dislodge the paintbrush handle from the brush encasement 1, the painter simply pulls on the paintbrush head or push the paintbrush handle from the rear end 13 until dislodgement. If the paintbrush head has wet paint residue, it is usually undesirable to remove the paintbrush by pulling on the paintbrush head because the wet paint residue can be messy and even can be damaging for the paintbrush. Therefore, by pushing the paintbrush out of the brush encasement 1 from the rear end 13, the painter can safely and cleanly dislodge the paintbrush without ever making contact with the paintbrush head. Also, the brush encasement 1 only houses the paintbrush handle, further preventing any paint residue from leaking within the brush encasement 1.

In reference to FIG. 1, the pistol grip 2 that provides increased handling over the paintbrush. The pistol grip 2 is adjacently positioned with the rear end 13 and is connected to the brush encasement 1. The pistol grip 2 is especially useful when paining near the edge of conjoining surfaces or when painting difficult or intricate designs. The finger guard 3 functions as a trigger guard for the present invention. More specifically, the finger guard 3 provides sufficient space for the fingers of the painter and provide protection to the fingers of the painter during the usage of the present invention. The finger guard 3 is positioned in between the front end 12 and the pistol grip 2, wherein the finger guard 3 is connected to the brush encasement 1 and the pistol grip 2.

Figure 4:
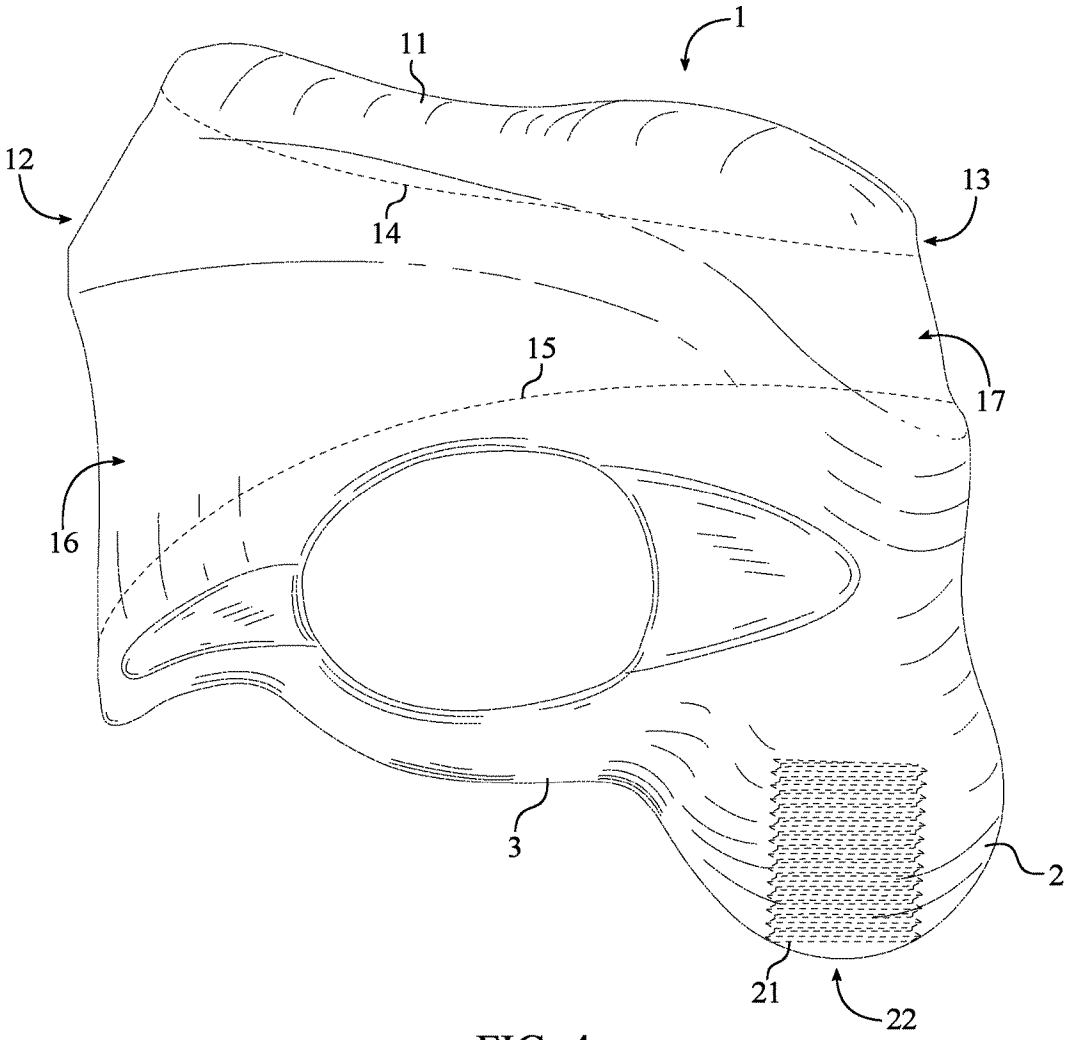
FIG. 4 is a side view of the present invention, showing the attachment cavity.

The present invention may further comprise a treaded attachment cavity 21 as shown in FIG. 4. More specifically, the treaded attachment cavity 21 traverses into a bottom end 22 of the pistol grip 2 and positioned relatively perpendicular with the brush encasement 1. The treaded attachment cavity 21 provides a fastening mechanism for standard paint roller extension poles that exists in the construction industry. As a result, the painter is able to attached different length paint roller extension poles to the present invention through the treaded attachment cavity 21 as needed.

Figure 5:
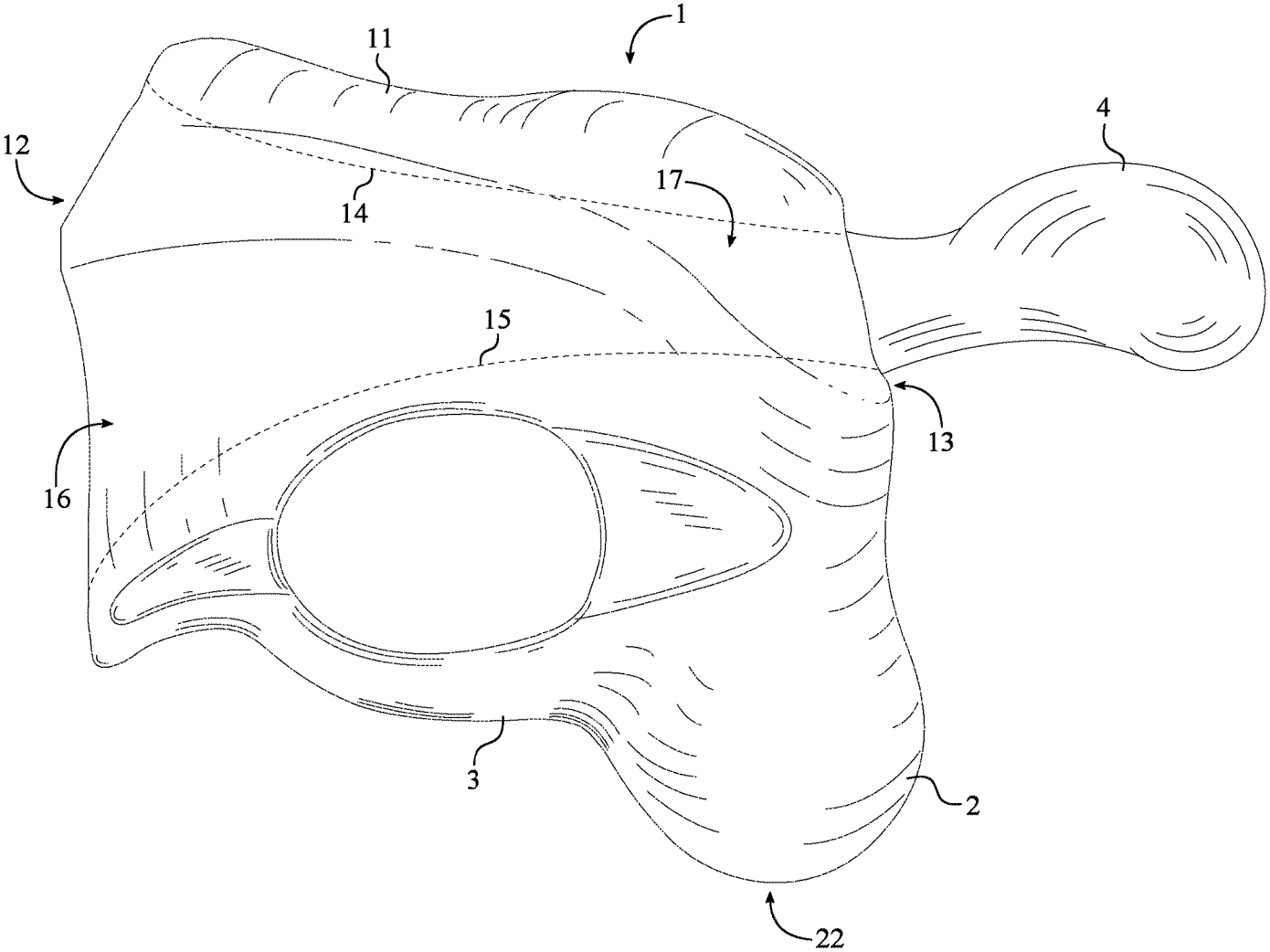
FIG. 5 is a side view of the present invention, showing the brush handle cover.

The present invention may further comprise a brush handle cover 4 as shown in FIG. 5. The brush handle cover 4 is shaped to enclose a distal end of the paintbrush handle as the distal end extends beyond the rear end 13. More specifically, the brush handle cover 4 is adjacently positioned with the rear end 13 and is mounted to the narrow receiving channel 17 so that the brush handle cover 4 is seamlessly able to be connected with the brush encasement 1. The brush handle cover 4 also improves the safety of the painter as the brush handle cover 4 can conceal a broken distal end of the paintbrush handle.

Figure 7:
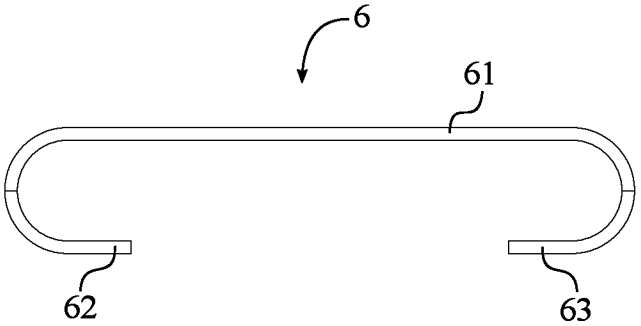
FIG. 7 is a top view of the belt clip.
Figure 6:
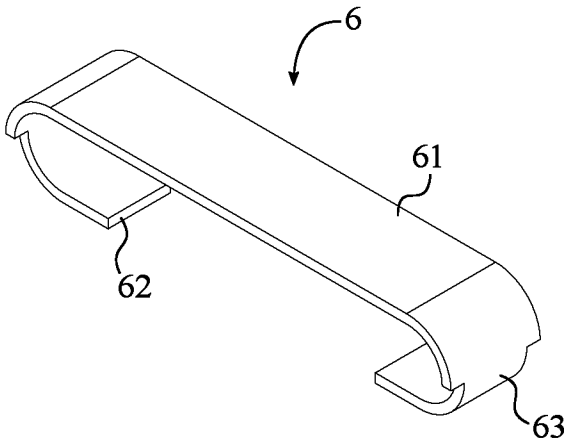
FIG. 6 is a perspective view of the belt clip.
Figure 8:
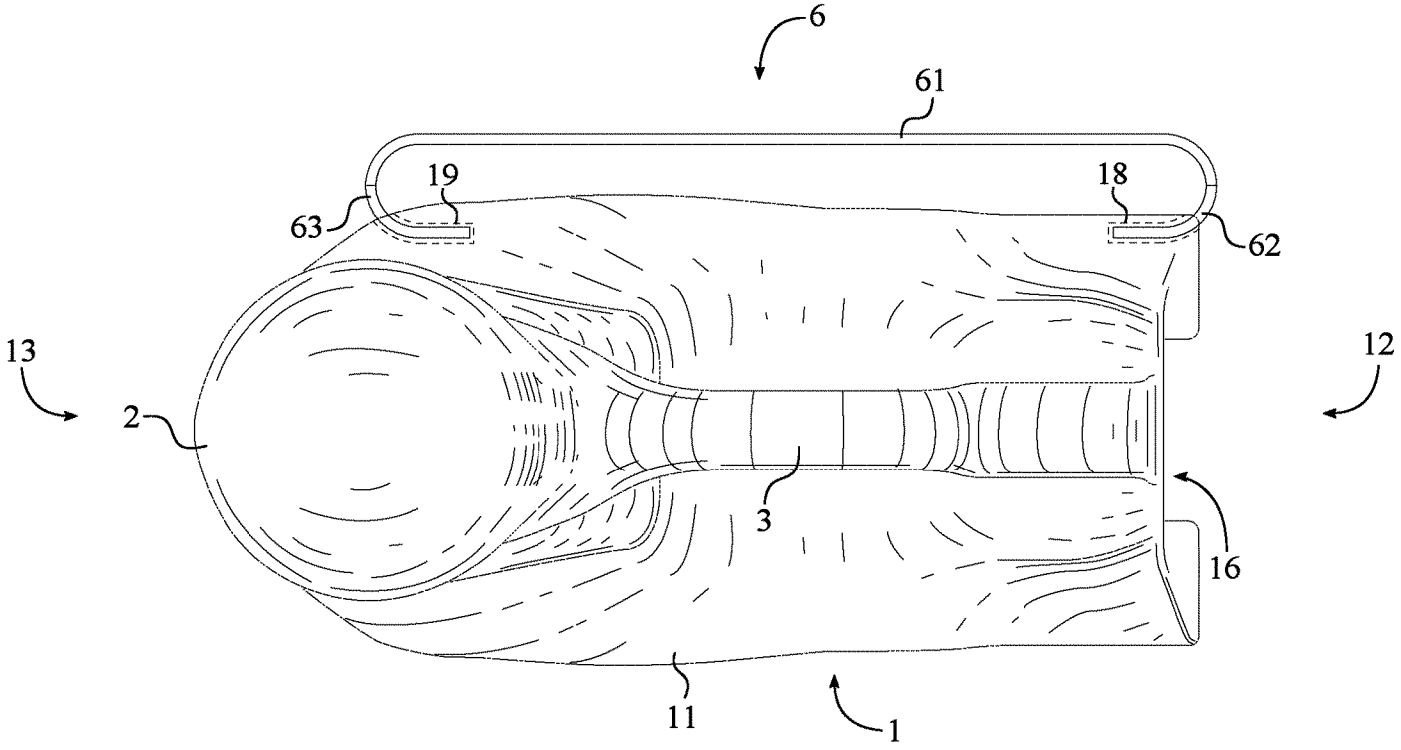
FIG. 8 is a bottom view of the present invention, showing the attached belt clip.

In reference to FIG. 6-8, the present invention may further comprise a belt clip 6 that secures the brush encasement 1 to the painter's utility belt so that the present invention can be easily transported. The belt clip 6 comprises an elastic member 61, a first retainer clip 62, and a second retainer clip 63 as belt clip 6 attaches to at least one first clip opening 18 and at least one second clip opening 19 of the elongated body 11. More specifically, the first retainer clip 62 and the second retainer clip 63 are oppositely positioned of each other along the elastic member 61 and connected with the elastic member 61 from each end in order to complete the belt clip 6. As a result, the belt clip 6 is able to extend and contract through the elastic member 61. Additionally, the first clip opening 18 traverses into the elongated body 11 from the front end 12 and positioned adjacent to the wide receiving cavity 16. The second clip opening 19 traverses into the elongated body 11 from the rear end 13 and positioned adjacent to the narrow receiving channel 17. The first retainer clip 62 is tensionably mounted within the first clip opening 18 while the second retainer clip 63 is tensionably mounted within the second clip opening 19, connecting the belt clip 6 to the brush encasement 1. The first clip opening 18 and the second clip opening 19 are positioned on the left side and the right side of the elongated body 11 in order to accommodate left hand usage and right hand usage of the paintbrush, respectively. For example, if the painter needs to use multiple paintbrushes for painting different colored surfaces, the painter can then simply insert a paintbrush into a brush encasement 1 and then secures the corresponding brush encasements 1 with the paintbrushes onto the utility belt or the clothing apparel with the belt clip 6. Therefore, the painter would have the capability to carry multiple paintbrushes at a time.

Figure 12:
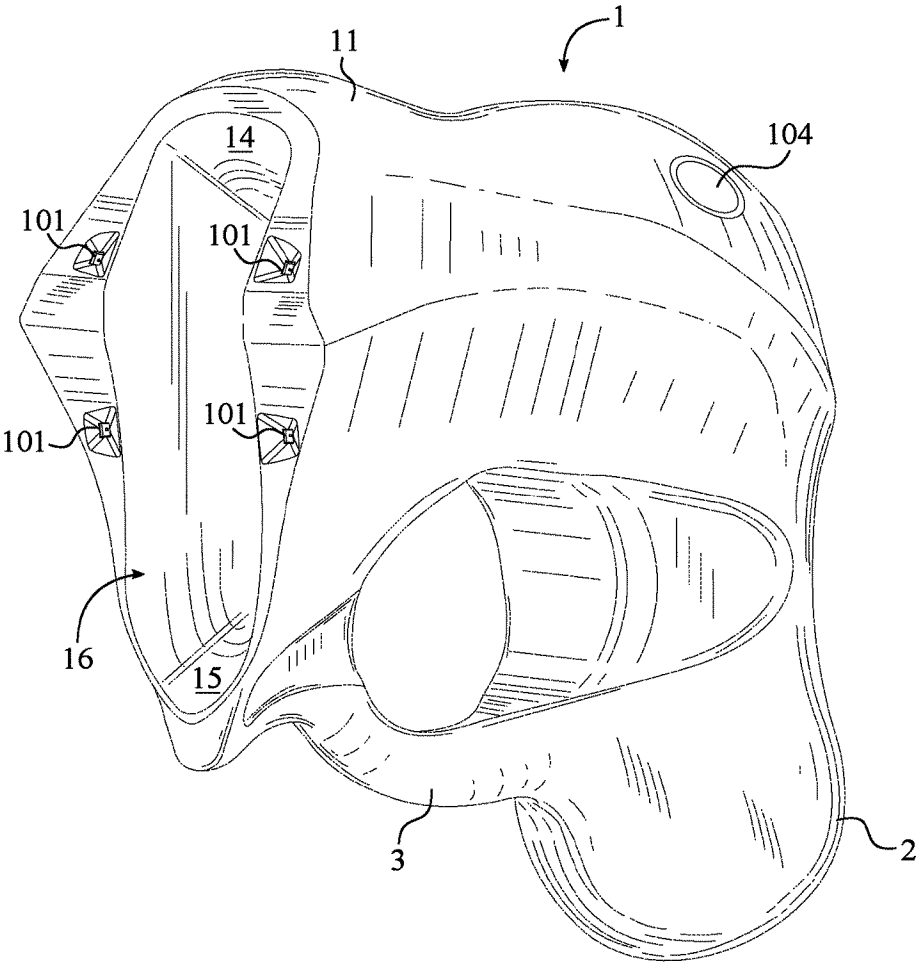
FIG. 12 is a front perspective view of the present invention, showing the plurality of integrated illuminating members.
Figure 13:
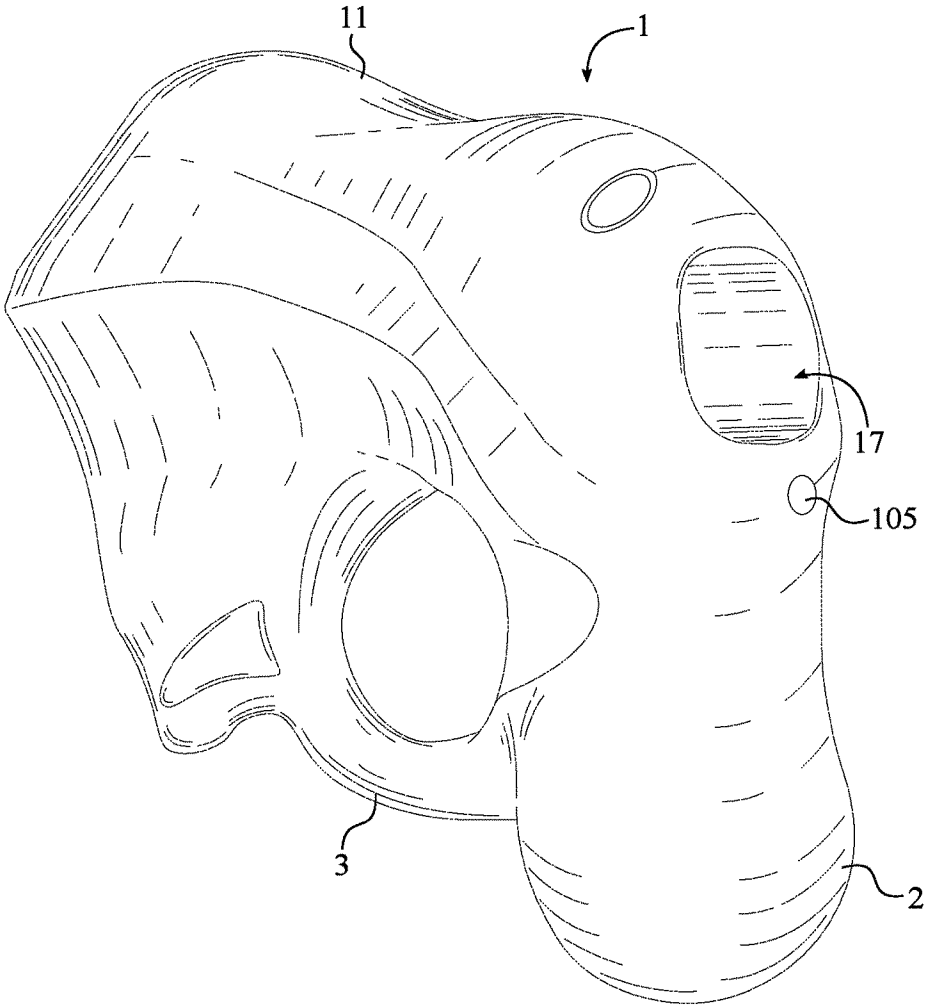
FIG. 13 is a rear perspective view of the present invention, showing the charging port.
Figure 14:
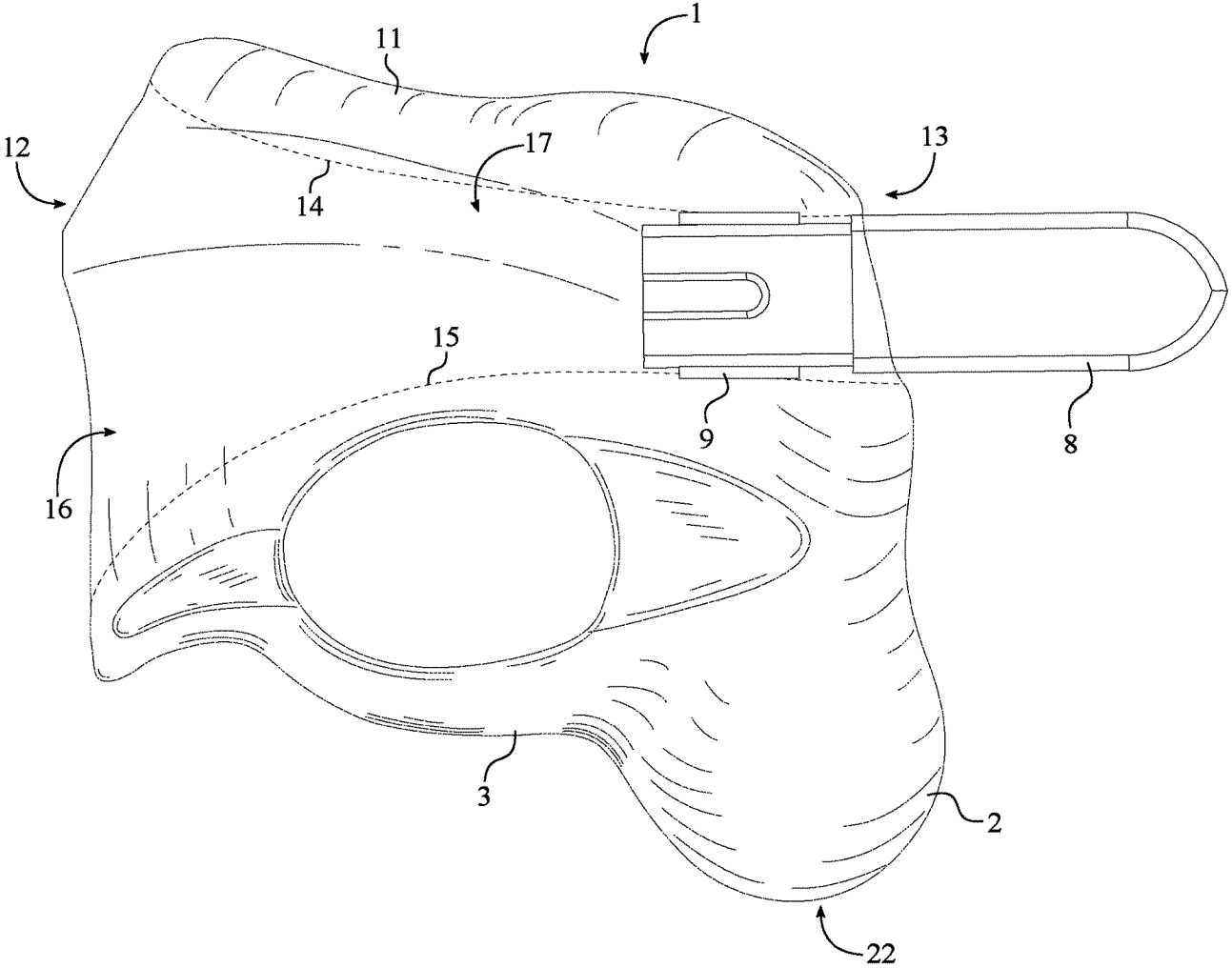
FIG. 14 is a side view of the present invention, showing the attachment between the brush encasement and the remote power source.
Figure 15:
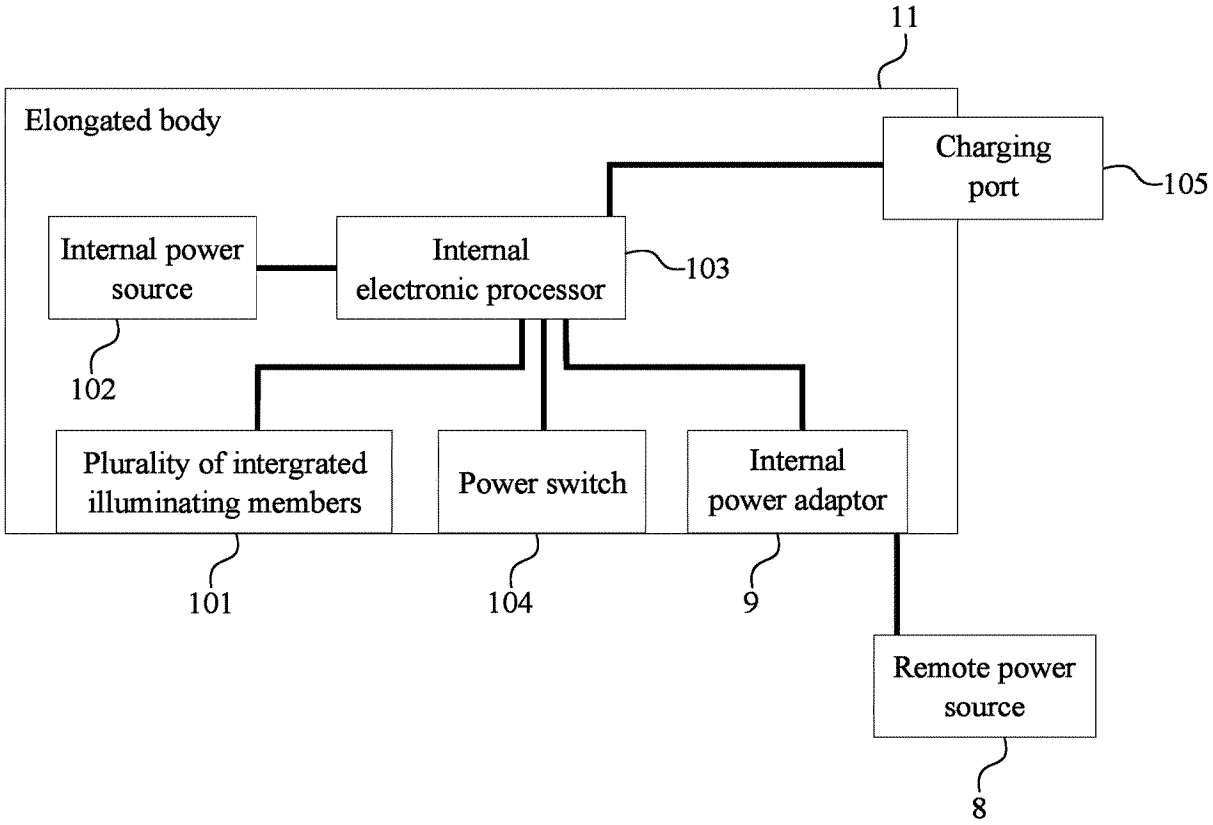
FIG. 15 is a basic electrical schematic for the integrated illuminating members.

In reference to FIG. 12-13, the present invention may further comprise a plurality of integrated illuminating members 101, an internal power source 102, an internal electronic processor 103, a power switch 104, and a charging port 105. These components collectively form an illuminating system for the present invention, wherein the illuminating system is affixed within the present invention. The illuminating system provides lighting onto a painted surface by directly projecting the light from the front end 12. As a result, the painted surface becomes visually enhanced, allowing the painter to more easily discern whether or not there are blemishes on the surface. Since the illuminating system moves with the paintbrush, the painter is less likely to apply additional coats to the painted surface. Fewer coats would be needed because the painter would notice these blemishes while painting and be able to correct them as the current coat is being applied. In reference to FIG. 12, FIG. 13, and FIG. 15, the plurality of integrated illuminating members 101 is externally connected onto the front end 12 so that lighting can be directed toward the painted surface. The internal power source 102 and the internal electronic processor 103 are enclosed by the elongated body 11 so that the internal power source 102 and the internal electronic processor 103 can be protected from the liquid paint. The power switch 104 is externally connected onto the rear end 13 in which allow the painter to easily access the power switch 104 while holding the present invention. The plurality of integrated illuminating members 101, the internal power source 102, and the power switch 104 are electrically connected with the internal electronic processor 103 so that the painter is able to selectively turn on and turn off the plurality of integrated illuminating members 101 through the power switch 104. The charging port 105, preferably a universal serial bus (USB) port, is traversed into the elongated body 11 from the rear end 13 and electrically connected with the internal electronic processor 103. The charging port 105 electrically connects with a charger unit that is powered by an external power supply so that the internal power source 102 can be recharged. For example, once the internal power source 102, preferably a rechargeable battery, is completely depleted, the painter can restore the rechargeable battery through the charging unit and the charging port 105.

The plurality of integrated illuminating members 101 is to be fitted within recessed grooves, where the recessed grooves are also perimetrically positioned around the wide receiving cavity 16. Each of the plurality of integrated illuminating members 101 is positioned and affixed within each recessed groove. The plurality of integrated illuminating members 101 preferably a light emitting diode (LED) since LED's require less power to operate in comparison to construction floor lamps that painters commonly use to illuminate a painted surface. These LED's also emit significantly less heat. Since the plurality of integrated illuminating members 101 is fitted within the recessed grooves, the plurality of integrated illuminating members 101 is protected from paint drips and paint residue that may leak from the bristles of the paintbrush while painting or while drawing paint out of a paint can. Since the plurality of integrated illuminating members 101 is positioned around the wide receiving cavity 16, the painter can direct light using the plurality of integrated illuminating members 101 with the motion of a paintbrush that is fitted within the brush encasement 1. The plurality of integrated illuminating members 101 is further protected by attaching a light cover atop the recessed grooves as the light cover is essentially a translucent protective surface that encloses the plurality of integrated illuminating members 101 within each recessed groove. Since paint may still leak from the bristles towards the brush encasement 1, the light cover provides supplemental protection to the plurality of integrated illuminating members 101 without blocking their light.

Figure 16:
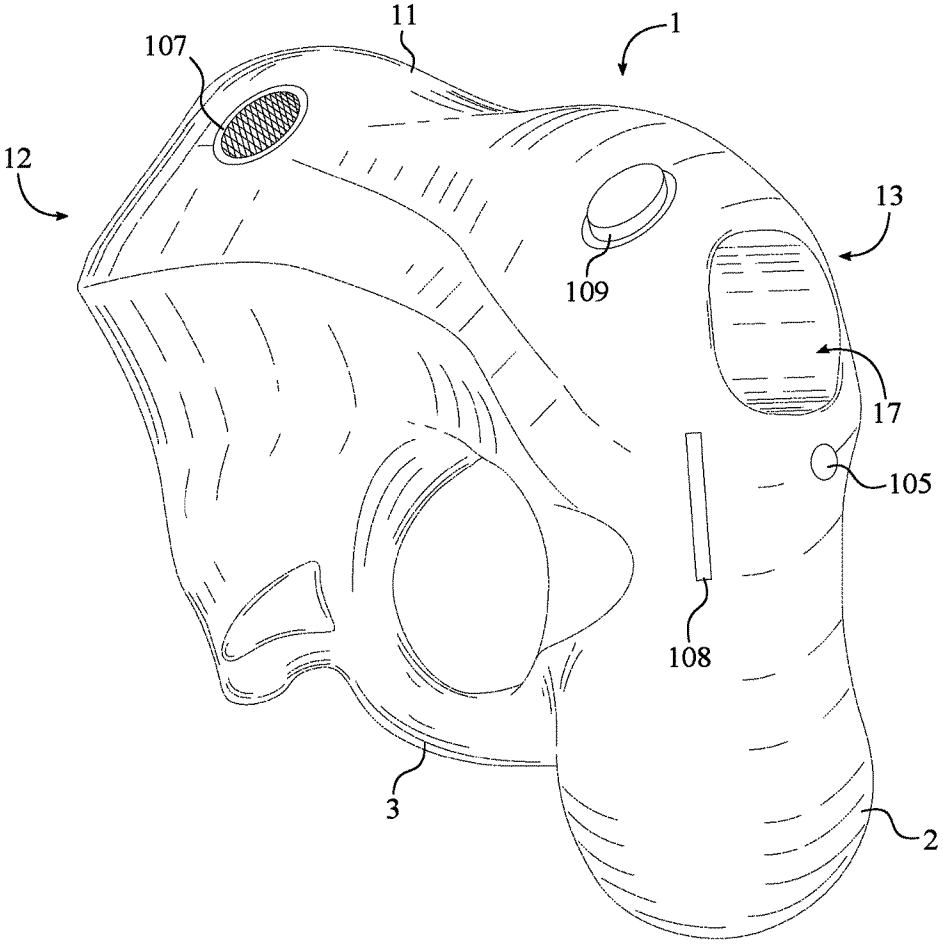
FIG. 16 is a rear perspective view of the present invention, showing the data receiving port, power knob, and the speaker.
Figure 17:
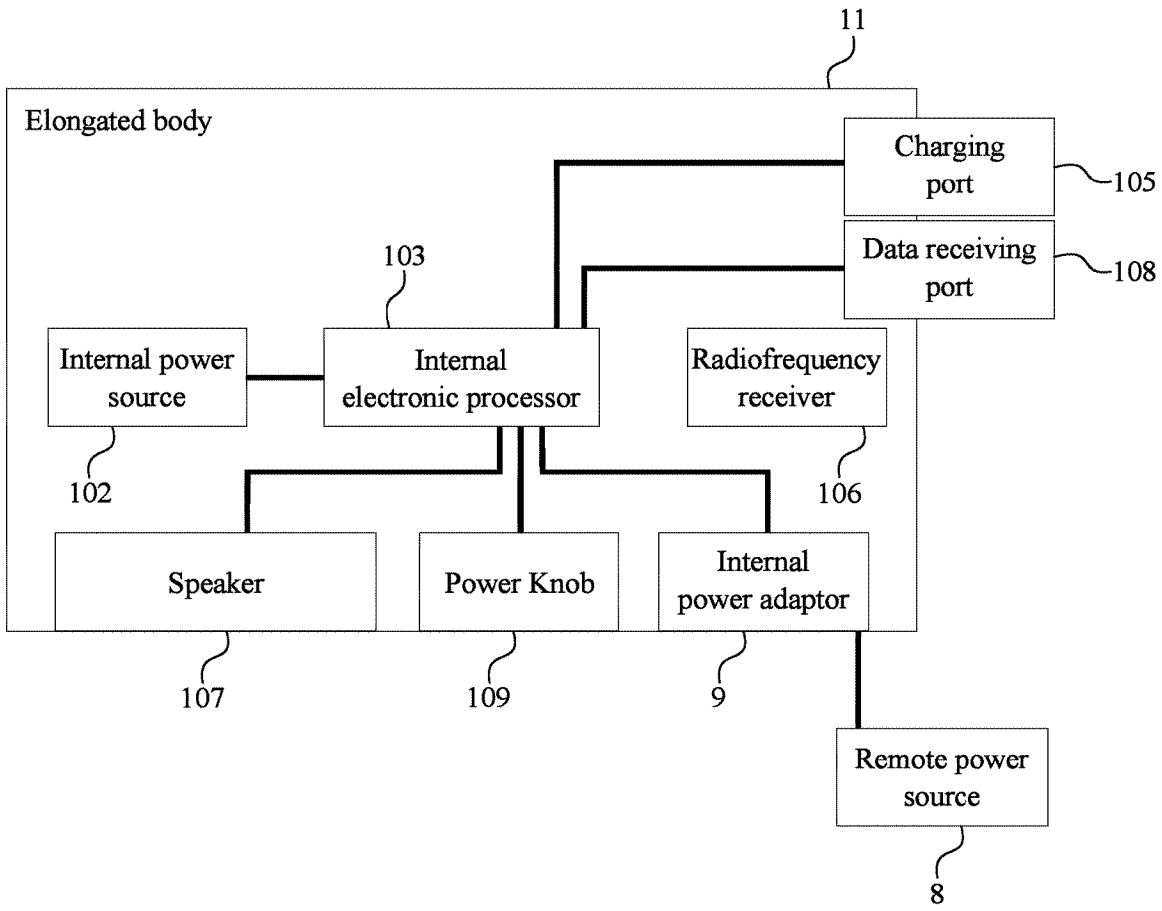
FIG. 17 is a basic electrical schematic for the audible system of the present invention.

In reference to FIG. 16-17, the present invention may further comprise an audible system that operates through the internal power source 102, the internal electronic processor 103, and the charging port 105. Additionally, the audible system comprises a speaker 107, a data receiving port 108, a power knob 109, and a radiofrequency receiver 106. These components collectively form the audible system that is affixed within the present invention. The radiofrequency receiver 106 has the ability to scan the local area for FM or AM stations. A scanning button is provided to trigger the scan of FM or AM stations, wherein the scanning button is preferably integrated onto the brush encasement 1. Upon selecting a desired station, the audible system is able to project the sound from the selected station through the speaker 107. In effect, these additional electronic components provide the painter with a portable audio system. In reference to FIG. 16, the speaker 107 is connected onto the front end 12 such that the speaker 107 is flush with the exterior surface so that sound can be directed toward the painter. The internal power source 102, the internal electronic processor 103, and the radiofrequency receiver 106 are enclosed by the elongated body 11 so that the internal power source 102, the internal electronic processor 103, and the radiofrequency receiver 106 can be protected from the liquid paint. The power knob 109 is externally connected onto the rear end 13 in which allow the painter to easily access the power knob 109 while holding the present invention. The data receiving port 108 enables the painter input audio files so that the audio files can be played through the present invention. The data receiving port 108 can include, but is not limited to, USB port, non-volatile memory card port, mini USB, and micro non-volatile memory card port. Similar to the charging port 105, the data receiving port 108 also traverses into the elongated body 11 from the rear end 13. The speaker 107, the data receiving port 108, the internal power source 102, the power knob 109, the radiofrequency receiver 106, and the charging port 105 are electrically connected with the internal electronic processor 103 so that the painter is able to selectively turn on and turn off the audible system through the power knob 109.

Additionally, the internal power source 102 can be recharged through a remote power source 8 and an internal power adaptor 9 of the present invention. More specifically, the internal power adaptor 9 is perimetrically positioned within the narrow receiving channel 17 and electrically connected with the internal electronic processor 103 so that the internal power adaptor 9 is able to electrically connected with the remote power source 8. Once the remote power source 8 is mounted to the narrow receiving channel 17 from the rear end 13, the remote power source 8 establishes an electrical connection with the internal electronic processor 103 through the internal power adaptor 9.

It should be known that the charging port 105 can be used to electrically connect the present invention with a computer device or a separate electronic device. The power switch 104 and the power knob 109 can be a variable switch that can permit power to be delivered in increment stages. More specifically, the power switch 104 allows the painter to control and vary the intensity of the lighting of the plurality of integrated illuminating members 101. The power knob 109 allows the painter to control the volume of the audible system. Also it should be noted that the data receiving port 108, the power switch 104, and power knob 109 are positioned on the exterior surface in a location that does not depart from the ergonomic nature of the brush encasement 1.

Figure 9:
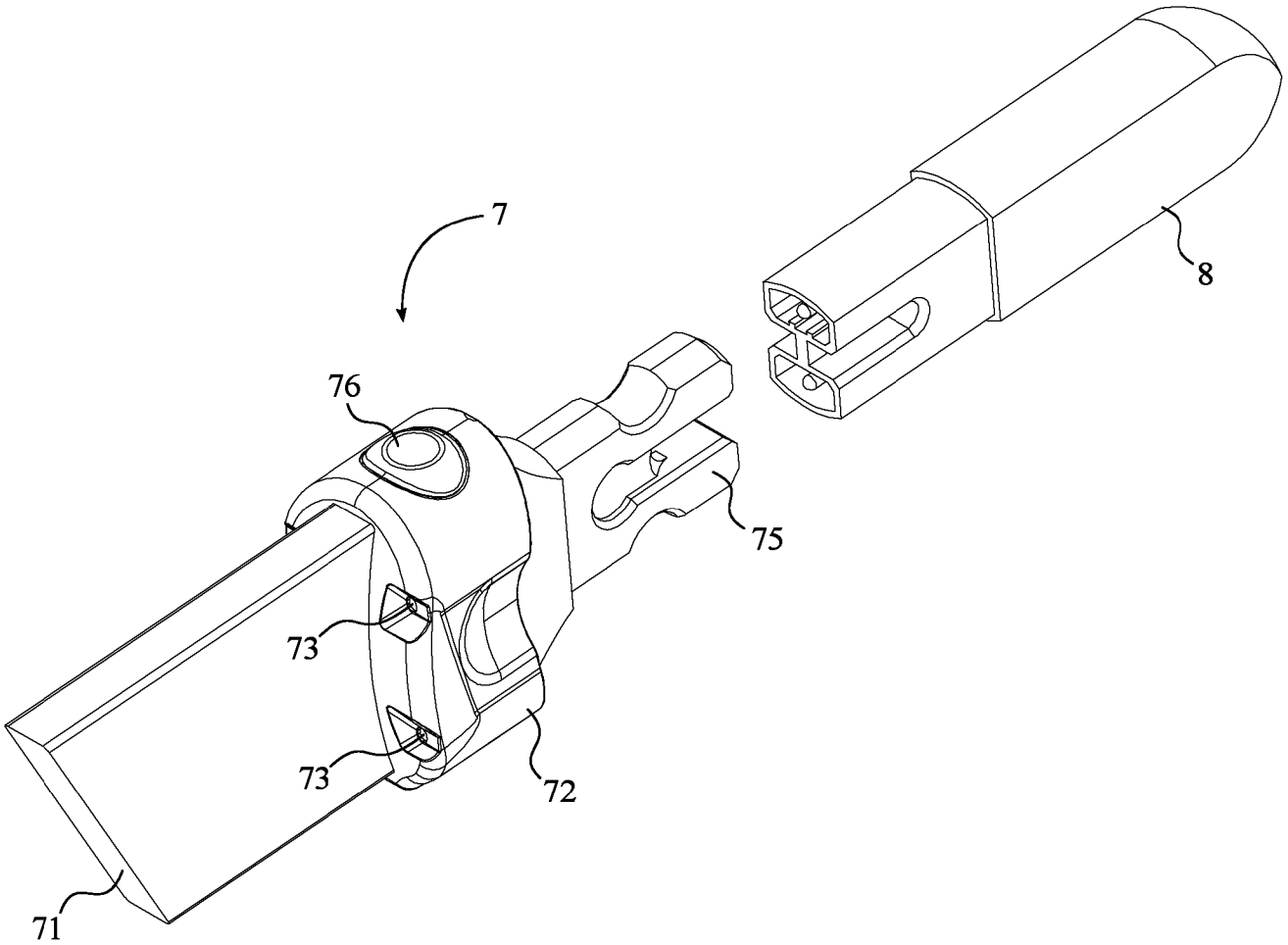
FIG. 9 is a perspective view the interchangeable illuminating brush handle and the remote power source.
Figure 10:
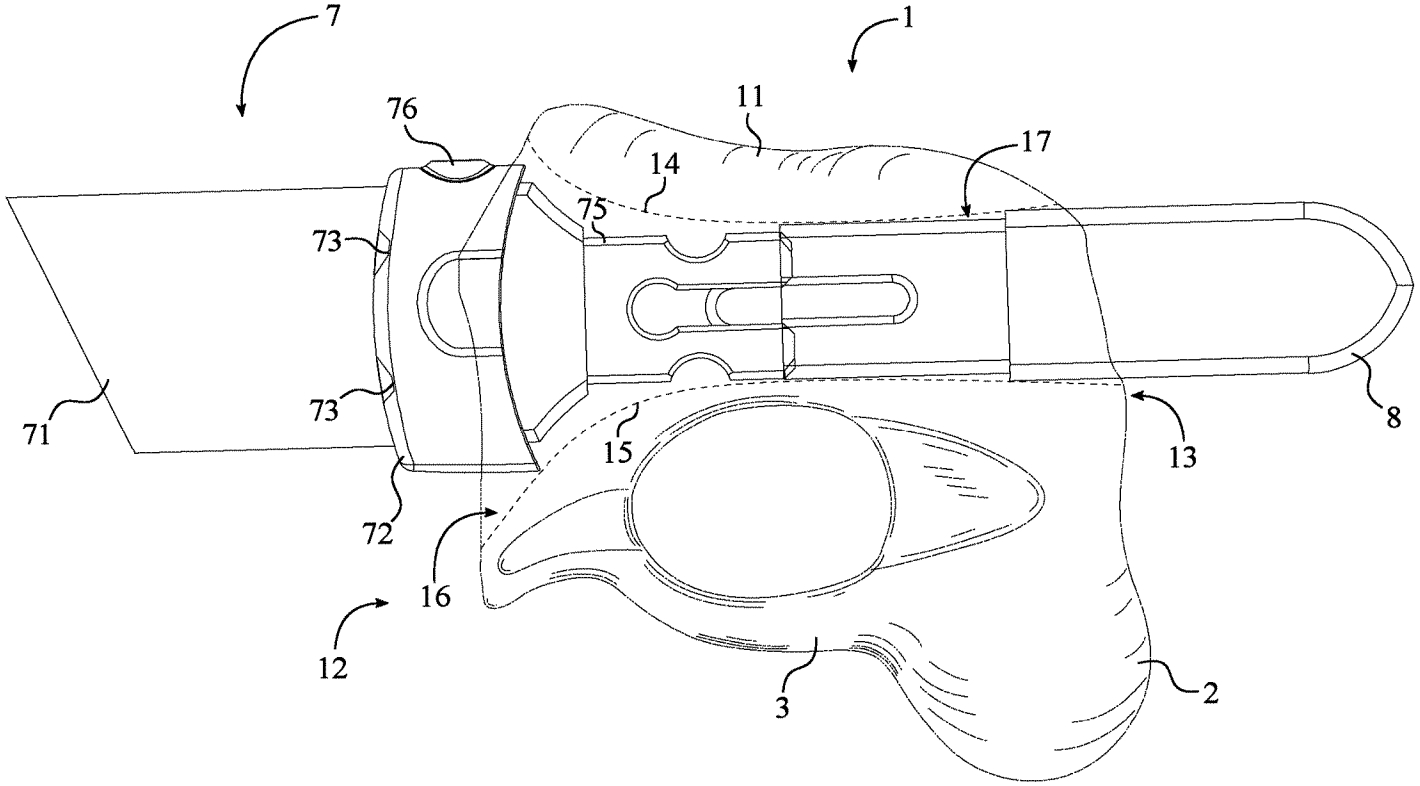
FIG. 10 is a perspective view the interchangeable illuminating brush handle and the remote power source within the present invention.
Figure 11:
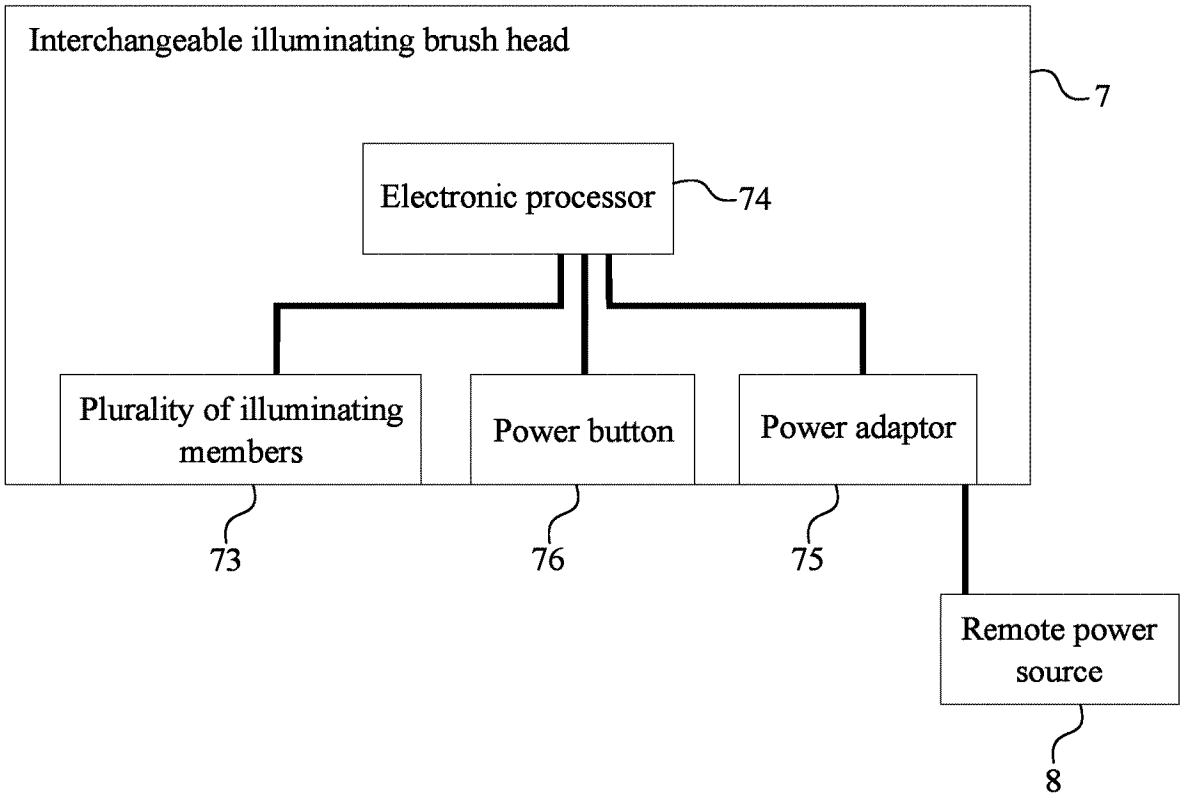
FIG. 11 is a basic electrical schematic for the interchangeable illuminating brush head.

In reference to FIG. 9-11, the present invention may comprise an interchangeable illuminating brush head 7 that replaces the standard paintbrush. The interchangeable illuminating brush head 7 would be attached into the wide receiving cavity 16 and the narrow receiving channel 17 and functions similar the standard paintbrush. Though, the interchangeable illuminating brush head 7 could be attached to the brush encasement 1, the interchangeable illuminating brush head 7 requires the remote power source 8 so that the present invention can function as an electronic paintbrush. More specifically, the interchangeable illuminating brush head 7 comprises a plurality of bristles 71, a ferrule 72, a plurality of illuminating members 73, an electronic processor 74, a power adaptor 75, and a power button 76. In reference to FIG. 8, the plurality of bristles 71 and the power adaptor 75 are connected to each other by the ferrule 72 as the plurality of illuminating members 73 and the power button 76 are externally connected to the ferrule 72. The plurality of illuminating members 73, the power adaptor 75, and the power button 76 is electrically connected with the electronic processor 74, which is internally positioned within the ferrule 72, to complete basic configuration of the interchangeable illuminating brush head 7. In order for the interchangeable illuminating brush head 7 to be functional within the present invention, the interchangeable illuminating brush head 7 is first inserted into the opened path to tensionably mount with the wide receiving cavity 16 and the narrow receiving channel 17 through the first elastic wall 14 and the second elastic wall 15. Then the remote power source 8 is mounted to the narrow receiving channel 17 from the rear end 13, wherein the remote power source 8 electrically connects with the interchangeable illuminating brush head 7 through the power adaptor 75.

Figure 18:
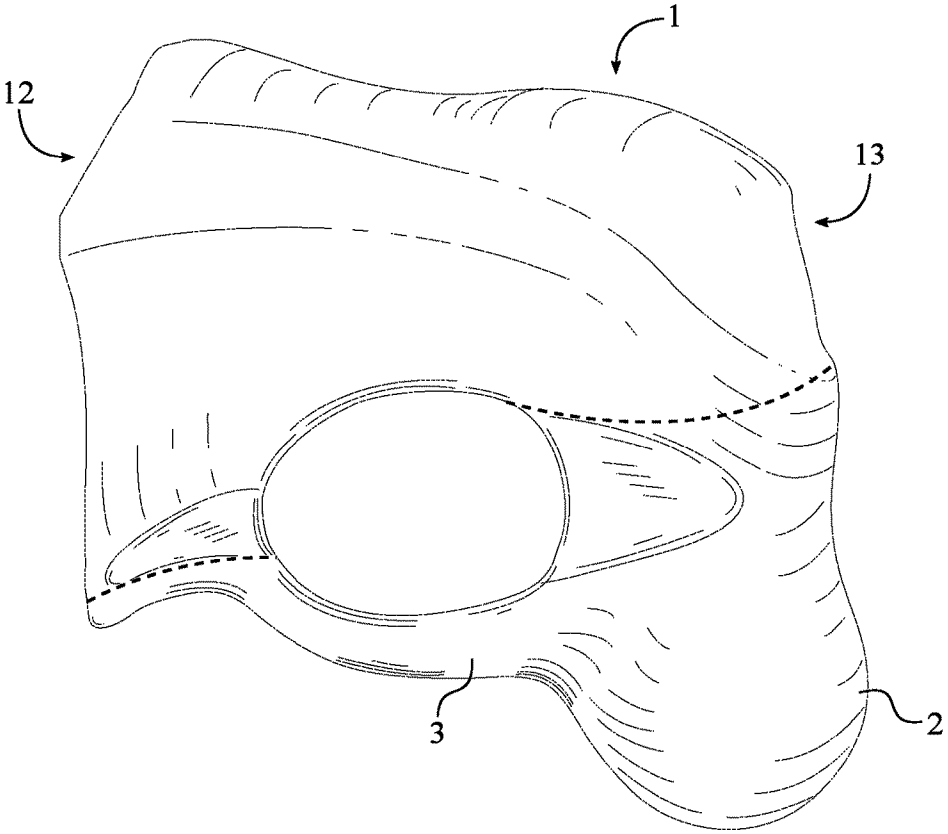
FIG. 18 is a side view of the present invention showing the compact configuration.
Figure 19:
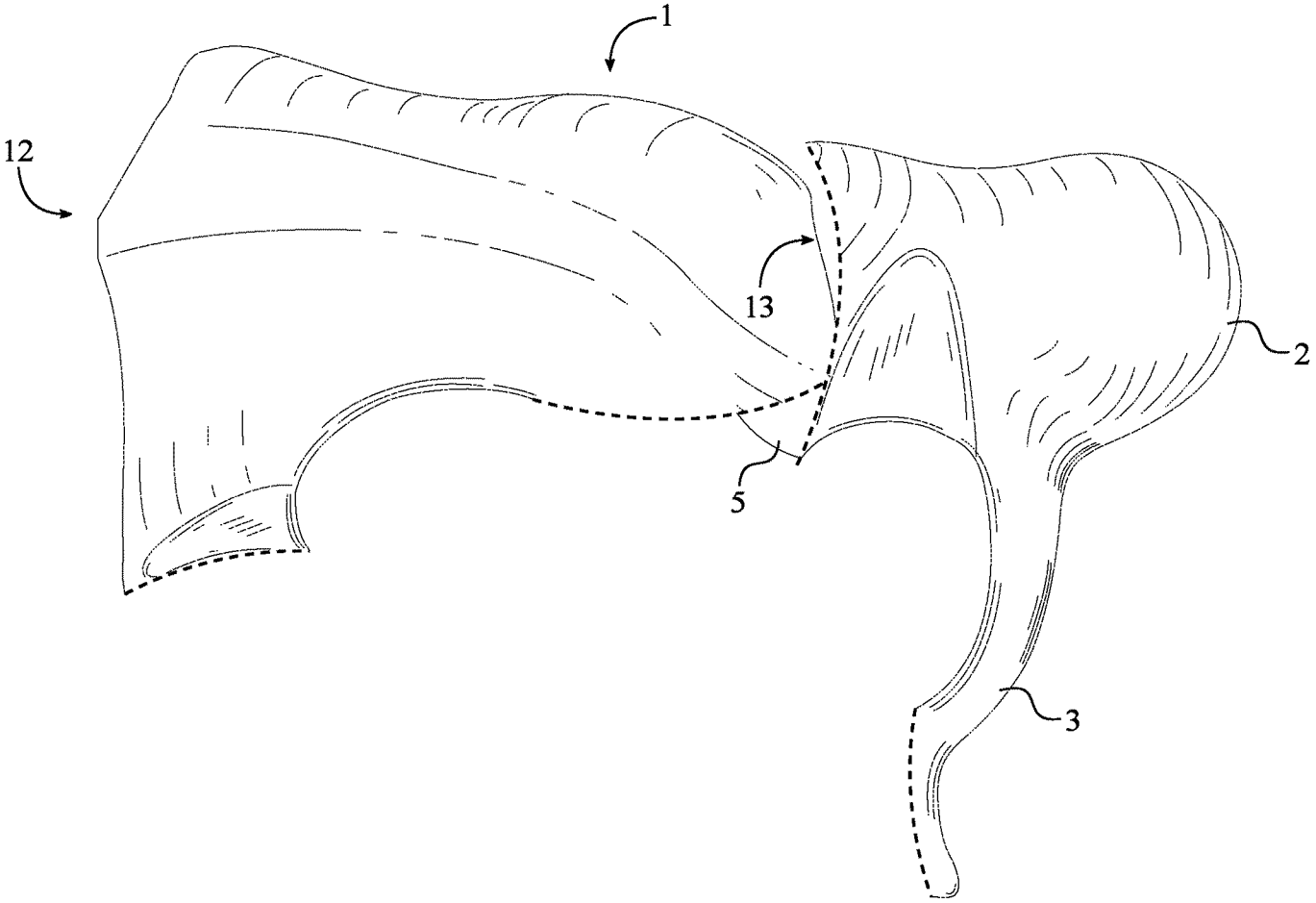
FIG. 19 is a side view of the present invention showing the extended configuration through the hinged mechanism.

In reference to FIG. 18-19, the present invention may comprise a hinged mechanism 5. More specifically, the pistol grip 2 is connected with the finger guard 3 while the pistol grip 2 and the finger guard 3 are conjointly connected to the brush encasement 1 by the hinged mechanism 5. The hinged mechanism 5 allows the painter to selectively moves the pistol grip 2 in between a compact configuration and an extended configuration. A rubber binding or similar existing or future technology can enwrap the pistol grip 2 to further enhance its gripping capability for the extended configuration or the compact configuration.

The present invention may also implement a wireless technology standard for exchanging data over short distances to allow the painter to communicate with others without having to carry around a cell phone. In order to implement the communication function, the elongated body 11 may comprise a microphone that the user would speak into while a connected headphone could allow the painter to listen to the sound or the sound could be projected through the speaker 107. An alternative embodiment of the present invention implements a tightening mechanism to modified the first elastic wall 14 and the second elastic wall 15. As opposed to a compressive pressure force being applied to the paintbrush handle, the tightening mechanism would function by decreasing the volume within the opened path by causing the first elastic wall 14 and the second elastic wall 15 to contract inwards towards each other. By contracting, the opened path is narrowed, and a compressive force from the first elastic wall 14 and the second elastic wall 15 would lodge the paintbrush handle within the brush encasement 1.

The Design is based on a six pointed star. The difference being the six points are actually curvaceous and rounded.

The present invention comes in multiple parts. The brush encasement 1, the brush encasement 1 with lights and other electronics, the brush encasement 1 with pistol grip 2 and finger guard 3, the interchangeable illuminating brush head 7 capabilities, the interchangeable remote power source 8 also performing the function and substitute like an extension handle that attaches to the rear end 13 of the brush encasement 1, a strap that attaches from the forearm to the brush encasement 1, and the belt clip 6 specifically designed to holster the paintbrush from the brush encasement 1 to the belt or waist of the user.

The paintbrush while inserted in the brush encasement 1 or the brush head, could easily rotate 180° from within the brush encasement 1 to accommodate the preferred usage of the paintbrush. Whether the angled sash of the paintbrush points up or down, it can be rotated either manually or squeezing or pulling the finger guard 3. Mechanically rotating the angle of the paintbrush.

An alternative embodiment of the present invention, the paintbrush can be inserted into the wide receiving cavity 16 and the narrow receiving channel 17 through a top end of the brush encasement 1, opposite of the pistol grip 2. A clamping mechanism within the present invention compresses the elongated body 11 from both sides so that the paintbrush can be secured within the wide receiving cavity 16 and the narrow receiving channel 17. Additionally, the pistol grip 2 may function as the brush encasement 1 along with the different electrical functionalities aforementioned within the present invention.

The industrial design of the present invention performs a function of comfort. Comfort is added by allowing the entire hand including the fingers to embrace the present invention from the palm to the fingers. The shape of the present invention naturally guides the fingers to their respective positions. The shape of the present invention allows for multiple methods of holding the invention. Not just one method. Although, the most popular method of holding the invention would be similar to a weapon such as a handgun. The present invention allows the painter to point and shoot or point-to-paint. The painful problems of holding a paintbrush is solved with the unique design of the present invention. Any and all other problems when working with an old fashioned paintbrush is solved with the present invention. This design and all of the components and features that make up the present invention for a brush hereby considers the old paintbrush and methods of making the old brush handle, completely obsolete. This design can be fixed to the paintbrush. The handle of the old paintbrush can be redesigned and would be derived from the present invention.

Although the invention has been explained in relation to its preferred embodiment, it is to be understood that many other possible modifications and variations can be made without departing from the spirit and scope of the invention as hereinafter claimed.

What is claimed is:

1. A multifunctional, electronic, light emittable and removable sleeve for a paintbrush comprising:

a brush encasement;

a pistol grip;

a finger guard;

the brush encasement comprising an elongated body, a wide receiving cavity and a narrow receiving channel;

the pistol grip being adjacently positioned with a rear end of the elongated body;

the pistol grip being connected to the brush encasement;

the finger guard being positioned in between a front end of the elongated body and the pistol grip;

the finger guard being connected to the pistol grip;

the wide receiving cavity traversing into the elongated body from the front end;

the narrow receiving channel traversing through the elongated body from the wide receiving cavity to the rear end;

a hinged mechanism;

the brush encasement and the pistol grip being hingedly engaged with each other via the hinged mechanism;

the brush encasement, the pistol grip and the finger guard conjointly forming a compact configuration and an extended configuration via the hinged mechanism;

the finger guard contacting against the brush encasement in response to the compact configuration being formed; and the finger guard being separated from the brush encasement in response to the extended configuration being formed.

2. The sleeve for a paintbrush as claimed in claim 1 comprising:

the elongated body comprising a first elastic wall and a second elastic wall;

the first elastic wall and the second elastic wall being oppositely positioned of each other; and the first elastic wall and the second elastic wall being internally extended along the wide receiving cavity and the narrow receiving channel.

3. The sleeve for a paintbrush as claimed in claim 1 comprising:

a treaded attachment cavity; and the threaded attachment cavity traversing into a bottom end of the pistol grip.

4. The sleeve for a paintbrush as claimed in claim 1 comprising:

a brush handle cover;

the brush handle cover being adjacently positioned with the rear end; and the brush handle cover being mounted to the narrow receiving channel.

5. The sleeve for a paintbrush as claimed in claim 1 comprising:

a belt clip;

the belt clip comprising an elastic member, a first retainer clip, and a second retainer clip;

the elongated body comprising at least one first clip opening and at least one second clip opening;

the first retainer clip and the second retainer clip being oppositely positioned of each other along the elastic member;

the first retainer clip and the second retainer clip being connected to the elastic member;

the first clip opening traversing into the elongated body from the front end;

the first clip opening being adjacently positioned with the wide receiving cavity;

the second clip opening traversing into the elongated body from the rear end;

the second clip opening being adjacently positioned with the narrow receiving channel;

the first retainer clip being tensionably mounted within the first clip opening; and the second retainer clip being tensionably mounted within the second clip opening.

6. The sleeve for a paintbrush as claimed in claim 1 comprising:

an interchangeable illuminating brush head;

a remote power source;

the interchangeable illuminating brush head being tensionably mounted to the wide receiving cavity and the narrow receiving channel by the first elastic wall and the second elastic wall;

the remote power source being mounted to the narrow receiving channel, adjacent to the rear end; and the remote power source being electrically connected with the interchangeable illuminating brush head.

7. The sleeve for a paintbrush as claimed in claim 6 comprising:

the interchangeable illuminating brush head comprising a plurality of bristles, a ferrule, a plurality of illuminating members, an electronic processor, a power adaptor, and a power button;

the plurality of bristles and the power adaptor being connected to each other by the ferrule;

the plurality of illuminating members and the power button being externally connected to the ferrule;

the plurality of illuminating members, the power adaptor, and the power button being electrically connected with the electronic processor; and the power adaptor being electrically connected with the remote power source.

8. The sleeve for a paintbrush as claimed in claim 1 comprising:

a plurality of integrated illuminating members;

an internal power source;

an internal electronic processor;

a power switch;

a charging port;

the plurality of integrated illuminating members being externally connected onto the front end;

the internal power source and the internal electronic processor being enclosed by the elongated body;

the power switch being externally connected onto the rear end;

the charging port traversing into the elongated body from the rear end; and the plurality of integrated illuminating members, the internal power source, the power switch, and the charging port being electrically connected with the internal electronic processor.

9. The sleeve for a paintbrush as claimed in claim 8 comprising:

a remote power source;

an internal power adaptor;

the internal power adaptor being perimetrically positioned within the narrow receiving channel;

the internal power adaptor being electrically connected with the internal electronic processor;

the remote power source being mounted to the narrow receiving channel, adjacent to the rear end; and the remote power source being electrically connected with the internal power adaptor.

10. The sleeve for a paintbrush as claimed in claim 1 comprising:

a speaker;

a data receiving port;

an internal power source;

an internal electronic processor;

a power knob;

a charging port;

a radiofrequency receiver;

the speaker being connected onto the front end;

the internal power source, the internal electronic processor, and the radiofrequency receiver being enclosed by the elongated body;

the power knob being externally connected onto the rear end;

the data receiving port and the charging port traversing into the elongated body from the rear end; and the speaker, the data receiving port, the internal power source, the power knob, the radiofrequency receiver, and the charging port being electrically connected with the internal electronic processor.

11. The sleeve for a paintbrush as claimed in claim 10 comprising:

a remote power source;

an internal power adaptor;

the internal power adaptor being perimetrically positioned within the narrow receiving channel;

the internal power adaptor being electrically connected with the internal electronic processor;

the remote power source being mounted to the narrow receiving channel, adjacent to the rear end; and the remote power source being electrically connected with the internal power adaptor.

* * * * *